US007344625B2

(12) United States Patent
Delescluse

(10) Patent No.: US 7,344,625 B2
(45) Date of Patent: Mar. 18, 2008

(54) ELEMENT FOR HANDLING CONNECTORS FOR ELECTROLYTIC CELLS WHICH ARE USED FOR THE PRODUCTION OF ALUMINUM

(75) Inventor: Patrick Delescluse, Cysoing (FR)

(73) Assignee: E.C.L., Ronchin (FR)

( * ) Notice: Subject to any disclaimer, the term of this patent is extended or adjusted under 35 U.S.C. 154(b) by 285 days.

(21) Appl. No.: 11/057,151

(22) Filed: Feb. 15, 2005

(65) Prior Publication Data

US 2005/0266735 A1 Dec. 1, 2005

Related U.S. Application Data

(63) Continuation of application No. PCT/FR2004/001131, filed on May 10, 2004.

(30) Foreign Application Priority Data

May 12, 2003 (FR) ..... 03 05679

(51) Int. Cl.
*C25C 3/10* (2006.01)

(52) U.S. Cl. ..... 204/288.4; 204/279; 204/243.1; 204/286.1; 204/288.5; 204/288.6; 269/217; 269/218; 269/221; 269/222

(58) Field of Classification Search ..... 204/243.1, 204/196.17, 196.3, 196.36, 196.37, 279, 204/286.1, 297.01, 288.4, 288.5, 288.6; 269/217, 218, 221, 222
See application file for complete search history.

(56) References Cited

U.S. PATENT DOCUMENTS 3,093,369 A 6/1963 Duclaux
3,627,670 A 12/1971 Duclaux
3,888,757 A * 6/1975 Roukema et al. ..... 204/297.15
3,919,071 A 11/1975 Mosé
5,128,012 A 7/1992 Olsen
5,378,338 A 1/1995 Langon et al.
5,876,585 A 3/1999 Schenk

FOREIGN PATENT DOCUMENTS

AU S-154066 12/2003
AU S-154067 12/2003

(Continued)

OTHER PUBLICATIONS

Tomago Aluminum News, Issue No. 1, Mar. 2003.

*Primary Examiner*—Bruce F. Bell
(74) *Attorney, Agent, or Firm*—Womble Carlyle

(57) ABSTRACT

The present invention relates to a handling device for an anode connector provided with at least two side trunnions and a tightening screw. The connector is generally capable of cooperating with attachment hooks of an aluminum production cell used in fused bath electrolysis production operations so as to enable connection of anodes onto the cell. The handling device has a tightening device capable of tightening the connector screw and affecting the tightness of the connector. The present invention also has a locking system that can lock the connector in a desired position in the handling device, by loosening the connector using the tightening device. The handling device also has at least one mobile member which typically has a support to support the connector in a closed position. The support can also displace the mobile member from its closed position to an open position, and vice versa.

41 Claims, 7 Drawing Sheets

FOREIGN PATENT DOCUMENTS

| | | |
|---|---|---|
| DE | 10117116 | 10/2002 |
| EP | 0178766 | 4/1986 |
| FR | 1437465 | 7/1966 |
| FR | 2039543 | 1/1971 |
| WO | WO-2004/035872 | 4/2004 |
| WO | WO-2004/101853 | 11/2004 |
| WO | WO-2005/009685 | 2/2005 |

* cited by examiner

ELEMENT FOR HANDLING CONNECTORS FOR ELECTROLYTIC CELLS WHICH ARE USED FOR THE PRODUCTION OF ALUMINUM

CROSS-REFERENCE TO RELATED APPLICATION

The present application is a continuation of International Application No. PCT/FR2004/001131 filed May 10, 2004, the content of which is incorporated herein by reference in its entirety.

BACKGROUND OF THE INVENTION

1. Field of the Invention

The invention relates to devices useful in an aluminum production plant employing fused bath electrolysis using the Hall-Héroult process. In particular, the present invention is directed to handling devices and related equipment useful in such plants.

2. Description of Related Art

Aluminum metal can be produced industrially by fused bath electrolysis, namely by electrolysis of alumina in solution in a molten cryolite bath called an electrolyte bath, using, for example, the well-known Hall-Héroult process. The electrolyte bath can be contained in pots called "electrolytic pots" comprising a steel pot shell that is lined on the inside with refractory and/or insulating materials, and a cathode assembly located in the bottom of the pot. Anodes, typically made of a carbonaceous material, are partially immersed in the electrolyte bath. The assembly formed by an electrolytic pot, its anodes and its electrolyte bath, is called an electrolytic cell.

The anodes are provided with a metallic stem used for the electrical and mechanical connection to a metallic frame called the anode frame, which is mobile with respect to a fixed gantry placed above the electrolysis pot. The anode stems are connected to the anode frame by hooks arranged on each side of the anode stems and removable connectors that fit on these hooks and force the anode stems into contact with the anode frame. French patent FR 2 039 543 (corresponding to U.S. Pat. No. 3,627,670) describes certain devices of this type.

During operation, an electrolysis plant requires work on electrolytic cells, particularly including the replacement of spent anodes by new anodes. The most modem plants are provided with at least one lifting and handling unit comprising a traveling crane that can be moved above and along the electrolytic cells, and a carriage fitted with several handling and work devices (often called "tools") the facilitate the replacement of anodes and other operations.

French patent FR 2 039 543 describes a handling device designed for handling connectors, and particularly placement, removal and transport of these connectors.

It often arises that connectors are not well gripped by well-known handling devices, which can cause accidents such as dropping of the connector, typically during transport or during placement.

SUMMARY OF THE INVENTION

The present invention relates to an anode connector handling device designed for use by the aluminum production industry, that avoid certain of the above disadvantages but that remain reliable, simple and compact.

An object of the invention was therefore to provide a handling device designed particularly for placement and removal of an electrolytic cell anode connector.

More precisely, an object of the invention was the provision of a handling device for an anode connector provided with two side trunnions and a tightening screw, wherein the handling device comprises a tightening device such as a spanner (or wrench), capable of cooperating with the tightening screw of the connector so as to modify its tightening state. The handling device further comprises a locking system capable of cooperating with the tightening device and the connector to lock it in a determined position (called the normal handling position) in the handling device by loosening the connector using the tightening device. The handling device further preferably comprises at least one mobile member having an open position and a closed position, and wherein the mobile member comprises a support capable of supporting the connector (typically by its side trunnions) when it is in the closed position and a means of displacing the mobile member from the closed position to the open position.

The applicant had the idea of providing the handling device with a locking system designed to maintain the connector in a normal handling position and a mobile member designed to act as a support if a locking failure occurs in the handling device. Thus the support of the mobile member provides a safety locking means when the connector is not in the normal handling position. For example, this type of failure could occur when the connector has been damaged or deformed or is worn.

Another object of the invention was to provide an anode connector provided with a gripping means capable of cooperating with a handling device locking system.

Another object of the invention was to provide a lifting and handling unit comprising at least one anode connector handling device according to the invention.

Yet another object of the invention was to provide a fused bath electrolysis aluminum plant that employs a handling device according to the invention.

Still yet another object of the invention was the provision of a fused bath electrolysis aluminum production cell that employs a connector according to the present invention.

And another object of the invention was a lifting and handling unit according to the invention employed in a fused bath electrolysis aluminum production plant.

Additional objects, features and advantages of the invention will be set forth in the description which follows, and in part, will be obvious from the description, or may be learned by practice of the invention. The objects, features and advantages of the invention may be realized and obtained by means of the instrumentalities and combination particularly pointed out in the appended claims.

BRIEF DESCRIPTION OF THE DRAWINGS

The invention will be better understood after reading the detailed description of a preferred embodiment of it as described below, illustrated with reference to the attached figures.

DETAILED DESCRIPTION OF A PREFERRED EMBODIMENT

The invention reduces the chance, or even prevents a connector from accidentally being dropped during handling. It has the advantage that it requires only a limited number of mobile elements, which increases the reliability of the handling device.

Further handling devices of the present invention are capable of being used for handling an anode connector having at least two side trunnions and a screw, and comprise a locking system designed to maintain the connector in a normal handling position and a at least one mobile member designed to act as a support if a locking failure occurs in the handling device.

Electrolysis plants designed for aluminum production typically comprise one or several electrolysis rooms (100) with a large number of electrolytic cells (1) normally arranged in rows or lines (typically side by side or end to end), each row or line typically comprising one or several hundred cells.

Figure 1:
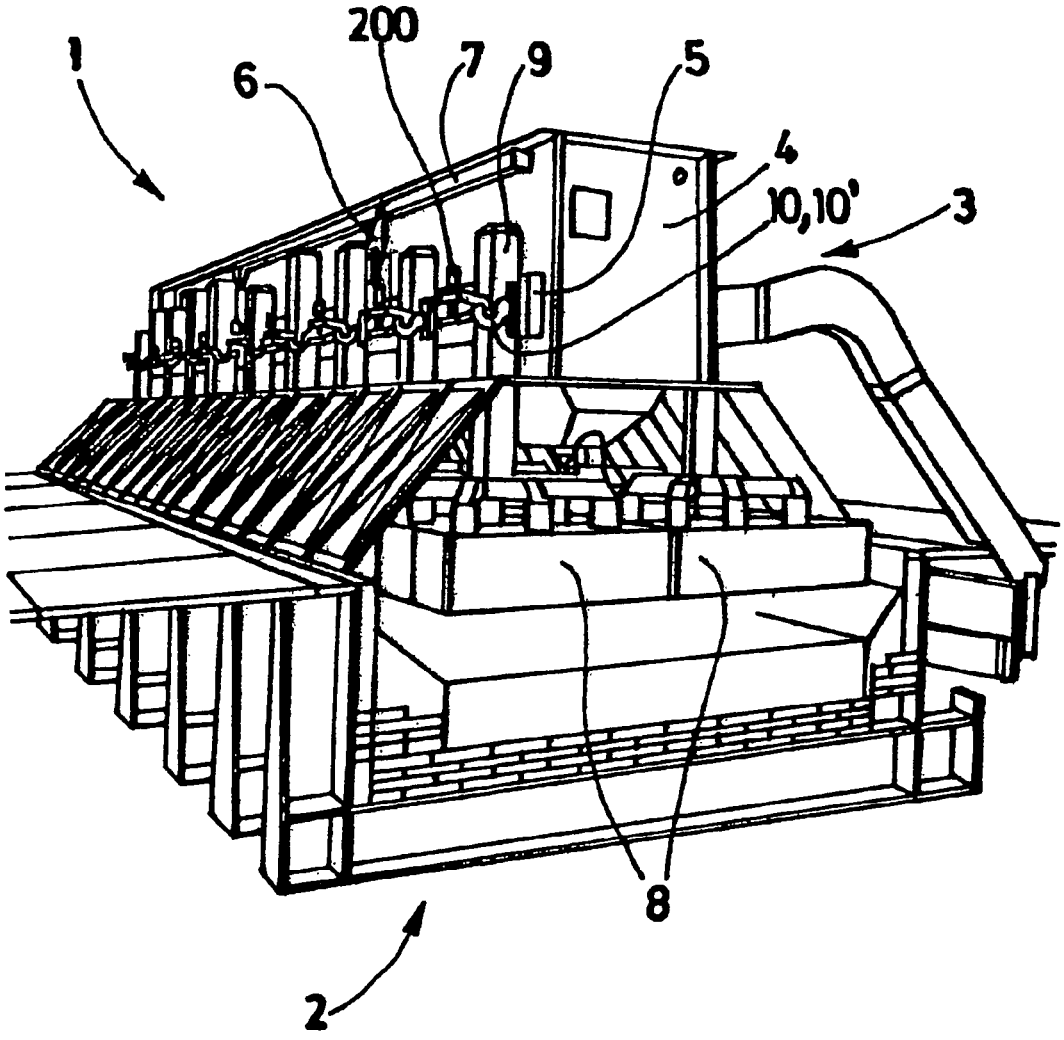
FIG. 1 illustrates a typical electrolytic cell, shown in perspective, designed for aluminum production.

As illustrated in FIG. 1, an electrolytic cell (1) comprises a pot (2) designed to contain the liquid metal and the electrolyte bath, a superstructure (3) and anodes (8), typically prebaked anodes. The superstructure (3) comprises a fixed gantry (4) and a mobile metallic anode frame (5). The anodes (8) are provided with a metallic stem (9) designed for attachment and electrical connection of the anodes (8) to the anode frame (5). The superstructure (3) also comprises at least one jack (not illustrated) coupled to the anode frame (5) by rods (6) and levers (7). The anode frame (5) may be displaced vertically (upwards or downwards) under the action of the jack or jacks.

The anode stems (9) are advantageously fixed to the anode frame (5) by connectors (200) typically comprising two levers (201, 202) capable of articulating about a common axis (213), tightening means (205, 206, 210, 211) to articulate the levers (201, 202) and two side trunnions (or studs) (212, 212') located on each side of the connector. The side trunnions (212, 212') usually form a common axis (213) and are typically comprised of the ends of a stem (usually cylindrical) that passes through the connector from one side to the other. The trunnions (212, 212') remain in the hollow (11, 11') formed by the hooks (10, 10') fixed to the anode frame (5) and located on each side of each anode stem (9).

Figure 3:
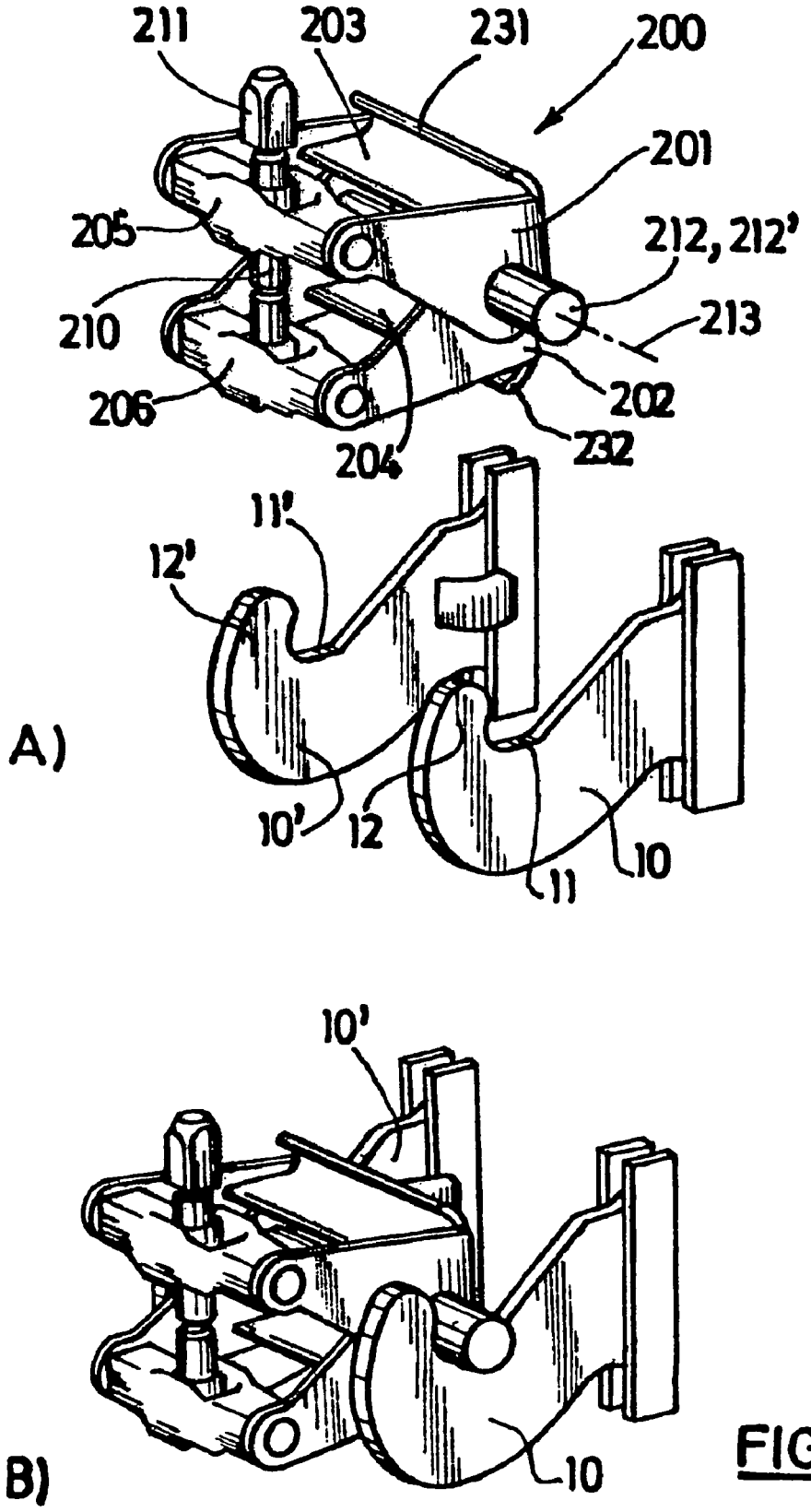
FIG. 3 shows a perspective view of an anode connector according to the present invention and attachment hooks for the connector.
Figure 4:
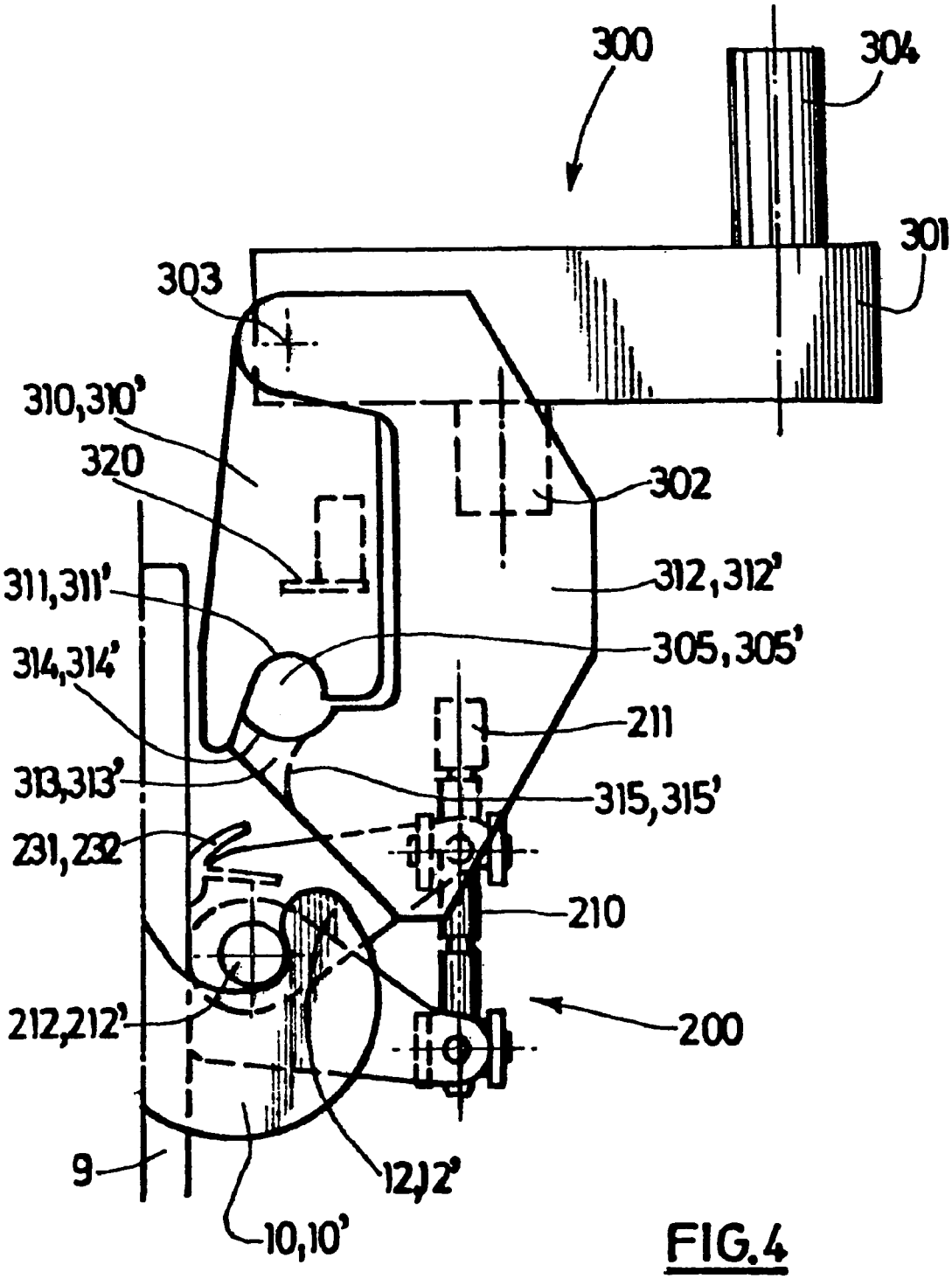
FIG. 4 illustrates a side view of a handling device according to the invention.

A connector (200) has at least a first state called the tight state, and a second state called the loose state. When a connector (200) is installed in the attachment hooks (10, 10') as illustrated in FIG. 3(B), the tight state is used either to fix the anode stem (9) on the anode frame (5), or to release the anode stem (9); in the tight state, the connector (200) applies a pressure in contact with the anode stem (9) and forces it into contact on the anode frame (5); in the loose state, the connector (200) no longer applies pressure in contact with the anode stem (9), such that the connector and the anode may be withdrawn.

A connector (200) may change between two states of tightness by actuating the tightening means (205, 206, 210, 211). These means normally comprises a screw (210) capable of cooperating with an external tightening device (302) such as a spanner (wrench), usually fixed to a handling device (300). The tightening screw (210) is typically provided with a head (211) that can be inserted in the tightening device (302) to tighten or loosen the connector (200). The tightening means also preferably includes nuts or similar attaching mechanisms (205, 206) fixed to connector levers (201, 202), preferably free to move, and capable of cooperating with the screw (210) so as to enable articulation of the levers (201, 202) and tightening/loosening of the connector (200).

The levers (201, 202) of a connector (200) generally comprise cross-pieces (203, 204) intended particularly to directly or indirectly transfer the connector tightening pressure into contact with anode stems.

Figure 2:
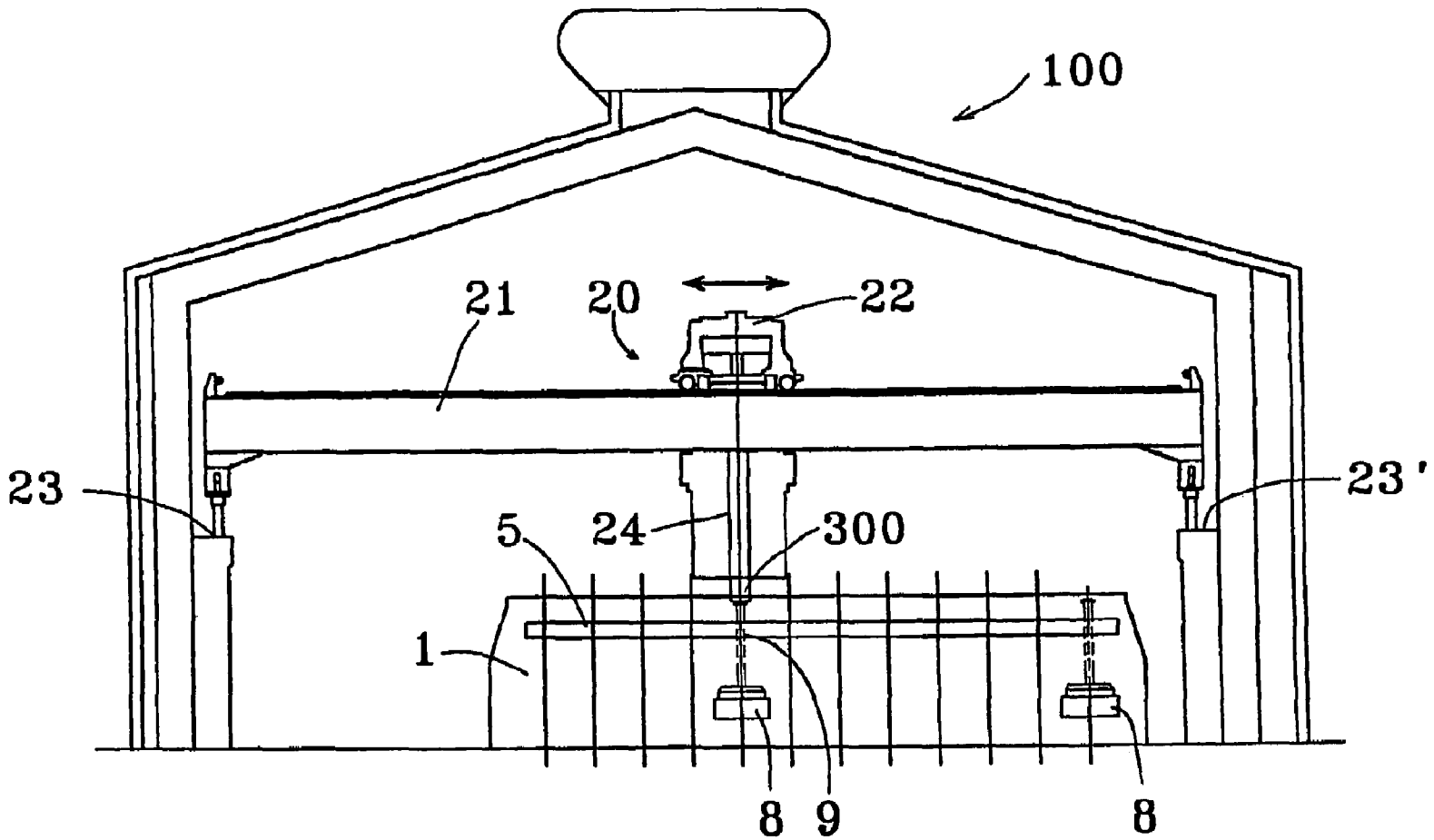
FIG. 2 shows a cross-section illustrating a typical electrolysis room designed for aluminum production.

As illustrated in FIG. 2, the electrolysis rooms (100) normally comprise at least one lifting and handling unit or "pot tending machine" (20). The unit (20) typically comprises a traveling crane (21) capable of being moved along the electrolytic cells on running tracks (23, 23'), a carriage (22) capable of moving along the traveling crane (21), and handling and working devices (often called "tools") such as a handling device (300) for the anode connectors (200). The handling device (300) is typically placed at the end of a telescopic arm (24). The handling device (300) typically comprises a frame (301) and an attachment means (304).

According to the present invention, the handling device (300) of an anode connector (200) provided with two side trunnions (212, 212') and a tightening screw (210), the connector being capable of cooperating with attachment hooks (10, 10') of an aluminum production cell (1) that employs fused bath electrolysis so as to enable connection of anodes (8) onto the cell. The handling device comprises a tightening device (202) capable of cooperating with the tightening screw (210) so as to modify the tightening state of the connector (200). The handling device comprises a locking system (310, 310', 320) capable of cooperating with the tightening device (302) and the connector (200) so as to lock the connector in a desired position in the handling device (300), by loosening the connector (200) using the tightening device (302). The handling device also comprises at least one mobile member (312, 312') with a first position called the open position and a second position called the closed position. The at least one mobile member (312, 312') preferably comprises a support (313, 313') capable of supporting the connector (200) when it is in the closed position and also includes a means (315, 315') of causing displacement of the at least one mobile member (312, 312') from the closed position to the open position.

The "desired position" is also referred to herein as "the normal handling position." In the normal position, the connector is correctly anchored in the handling device, unless a problem arises, and can be displaced and transported. In the normal handling position, the support (313, 313') is typically not needed to carry the connector; in other words the support is only designed to carry the connector in the case of a failure. Furthermore, in the normal handling position, the tightening screw (210) normally remains engaged in the tightening device (302). The connector (200) can then be pulled out or withdrawn from the normal handling position by tightening the connector using the tightening device (302).

In one advantageous embodiment of the invention, the support (313, 313') is capable of supporting the connector (200) through the side trunnions (212, 212') when one or more of the mobile members (312, 312') is in the closed position. This embodiment provides excellent stability to the connector when it is placed on the support. In this embodiment, the support (313, 313') is advantageously provided with a concave recess (314, 314') that is oriented essentially downward during use, such that a trunnion (212, 212') of the connector can fit into this recess.

In one particularly advantageous embodiment of the invention, the at least one mobile member (312, 312') also comprises a safety locking means (314, 314') to impede or prevent displacement of the mobile member or each mobile member (312, 312') from the closed position to the open position when the connector (200) is resting on the support (313, 313'). This situation can arise when the connector is not locked (or not correctly locked) in the normal handling position, in which case the connector can be drawn downwards by gravity until it rests on the support (313, 313'). This situation may also arise when the connector is released from its normal position during handling, typically following a false maneuver. This embodiment prevents an operator from attempting to install a connector that is badly fixed in the handling device, which could make the connector drop.

In one preferred embodiment of this embodiment of the invention, the handling device comprises two mobile members (312, 312') each comprising a support (313, 313'), and each support (313, 313') comprises at least one recess (314, 314') in which a side trunnion (212, 212') can be fitted. The dimensions of each recess (314, 314') are such that when the connector is locked in the desired position (called the normal position), each mobile member (312, 312') can move without being hindered; whereas when the side trunnions (212, 212') of the connector (200) rest in the recesses (314, 314'), displacement of the mobile member (312, 312') is mechanically impeded, or preferably substantially prevented, by a stop effect, formed by the safety locking means.

The mobile member (312, 312') is typically capable of being moved by pivoting about an axis (303).

In one advantageous embodiment of the invention, the locking system (310, 310', 320) comprises at least one attachment means (320) that can cooperate with the connector (200) and the tightening device (302) so as to lock the connector (200) in the handling device (300). The attachment means (320) is typically able to cooperate with the connector (200) through a gripping means (231, 232) provided on the connector.

Cooperation between the connector (200), the tightening device (302) and the attachment means (320) fixes the connector in the handling device when the connector (200) is loosened. For example, as illustrated in FIG. 5(D), the attachment means (320) fits into a gripping means (231, 232) of the connector (200) during the loosening operation of the connector using the tightening device (302). In this position, the connector (200) cannot move vertically (particularly due to the attachment means (320) that supports the connector), or horizontally (due to the screw (210) that remains engaged in the tightening device (302)).

The attachment means (320) is advantageously a fixed or mobile part capable of cooperating with the connector (200), typically by insertion in a gripping means (231, 232) provided on the connector, so as to lock it. The attachment means (320) is typically a stud, a pin or a protuberance or any other desired similar device.

It was found advantageous to fix the attachment means (320) to the guide means (310, 310').

In one advantageous embodiment of the invention, the locking system (310, 310', 320) comprises at least one guide means (310, 310') that may be fixed or mobile, designed to guide insertion of the connector into the locking system. The guide means (310, 310') typically comprises a fork. The system preferably comprises two forks (310, 310') arranged so as to allow insertion of the connector between the forks and provide guidance for each trunnion (212, 212') of the connector by each fork (310, 310'). This embodiment facilitates placement and locking of the connector in the determined position. The shape of the recess (311, 311') of each fork (310, 310') is advantageously complementary to the recess in the trunnion (212, 212') of the connector, in order to further limit displacements of the connector. The bottom of the recess (311, 311') may limit vertical displacements of the connector.

The guide means (310, 310') is advantageously mobile. It may optionally be provided with an elastic return means for bringing it back into an equilibrium position. The mobility of the guide means assures that the locking system has some flexibility when a connector is being inserted in the handling device and thus avoids possible degradation of elements of the system. It also overcomes some differences in the size of the connectors.

The recesses (311, 311', 314, 314'), if any, advantageously form an opening (305, 305') preventing a trunnion (212, 212') from moving sideways out of the connector.

The means (315, 315') of causing displacement of the mobile member or each mobile member (312, 312') from the closed position to the open position advantageously includes at least one cam formed on the mobile member and configured such that it can cooperate with the hooks (10, 10') (and more precisely with the ends (12, 12') of the hooks) so as to cause displacement of the mobile member or each mobile member (312, 312') from the closed position to the open position by a relative movement between the handling device (300) and the attachment hooks (10, 10'). The simplicity of this embodiment makes the handling device very reliable. The means (315, 315') may optionally be a mechanical, pneumatic or electromechanical controlled means.

A particularly advantageous connector (200) suitable for use in the present invention advantageously comprises two levers (201, 202), two side trunnions (212, 212'), a tightening screw (210), and also at least one gripping device (231, 232) capable of cooperating with the locking system (310, 310', 320) of the handling device so as to lock the connector in a desired position, called the normal handling position. In one advantageous embodiment of the invention, the two levers (201, 202) each comprise a cross-piece (203, 204) and the gripping means is a projecting rim (231, 232) provided on at least one of the cross-pieces (203, 204). This connector (200) can be handled by the handling device (300) according to the invention.

Figure 5:
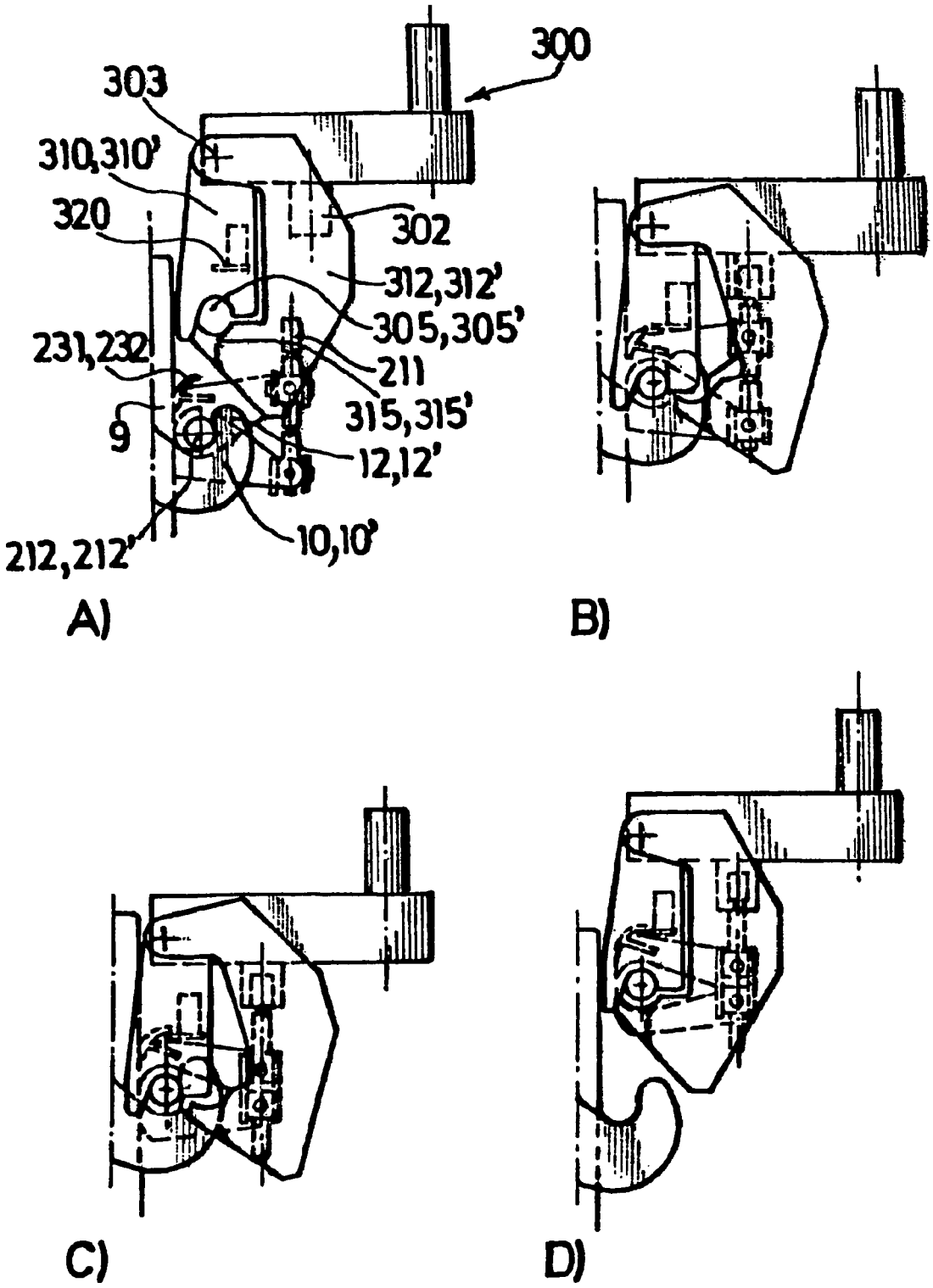
FIGS. 5 and 6 illustrate operation of the handling device for an anode connector according to the invention.
Figure 6:
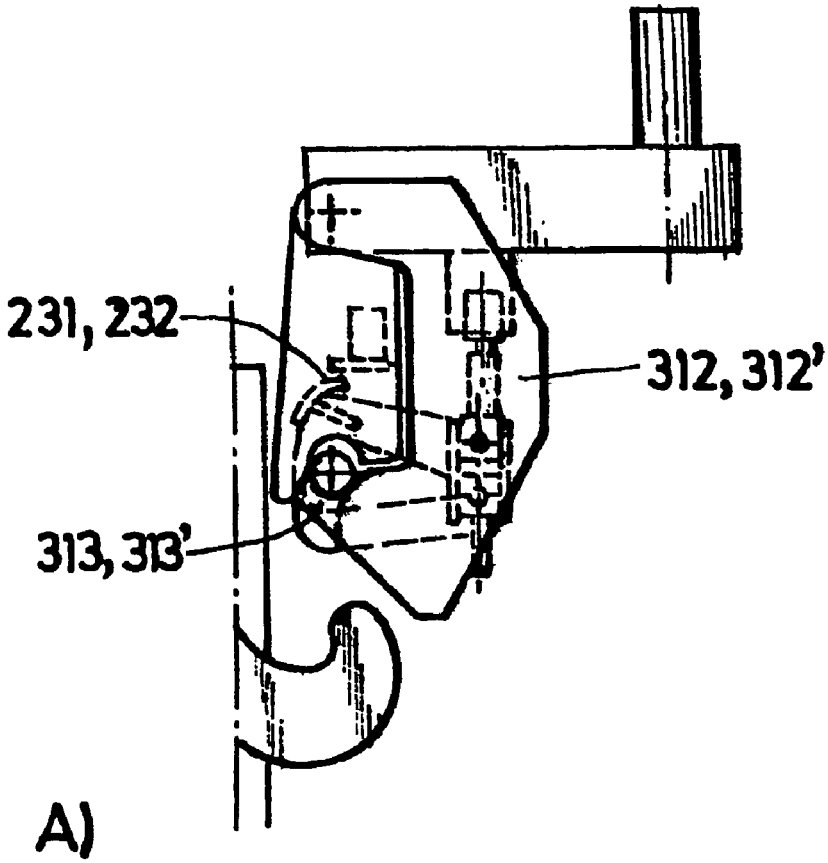
Figure 6:
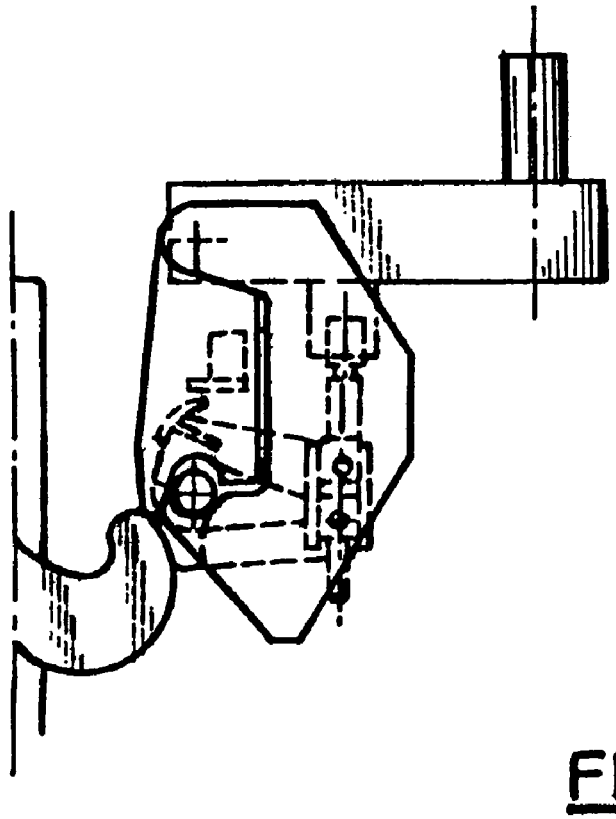

Operation of the handling device system (300) according to the present invention is illustrated using the particular example in FIGS. 5 and 6 related to a preferred embodiment of the invention in which the handling device comprises two forks (310, 310') and two mobile members (312, 312') provided with a cam (315, 315') and that can pivot about an axis (303).

The example illustrated in FIG. 5 corresponds to a typical case in which the connector (200) is correctly inserted in the handling device. In this example, the connector (200) is initially inserted in the hooks (10, 10') and in contact on an anode stem (9) in the tight state (FIG. 5(A)). In order to remove the connector (200), the handling device (300) is brought close to the connection so as to insert the connector (200) and the hooks (10, 10') between the mobile members (312, 312'). At least one cam (315, 315') then slides on the ends (12, 12') of the hooks and cause pivoting of the mobile members (312, 312') that then change to the open position. The head of the screw (211) is inserted in the tightening device (302) and the trunnions (212, 212') of the connector are engaged in the forks (310, 310') (FIG. 5(B)). The connector is then loosened using a tightening device, which causes insertion of the attachment means (320) in the connector and locking of it in a normal position inside the handling device (FIG. 5(C)). The handling device is then raised, which makes the mobile members (312, 312') pivot under the effect of gravity that then return to the closed position (FIG. 5(D)). The mobile members may be moved without hindrance, such that if it is required to install the connector on another anode, the same procedure can simply be performed in the reverse direction.

The example illustrated in FIG. 6 shows a case in which the connector (200) has not been correctly inserted in the handling device. In this example, the attachment means (320) is not inserted in the gripping means (231, 232) of the connector, such that it is not locked in the normal handling position. The trunnions (212, 212') then rest on the support (313, 313') of each mobile member (312, 312') (FIG. 6(A)) by gravity. In this position, the recesses (314, 314') prevent movement of the mobile members (312, 312'). More precisely, in this position, a force applied to move mobile members into the open position pushes the inner rim of the recesses into contact with the trunnions, which prevents movement of the mobile members since any lateral movement of the connector is locked by the tightening device (302). In practice, the handling device is then moved outside the hooks, as shown in FIG. 6(B).

Figure 7:
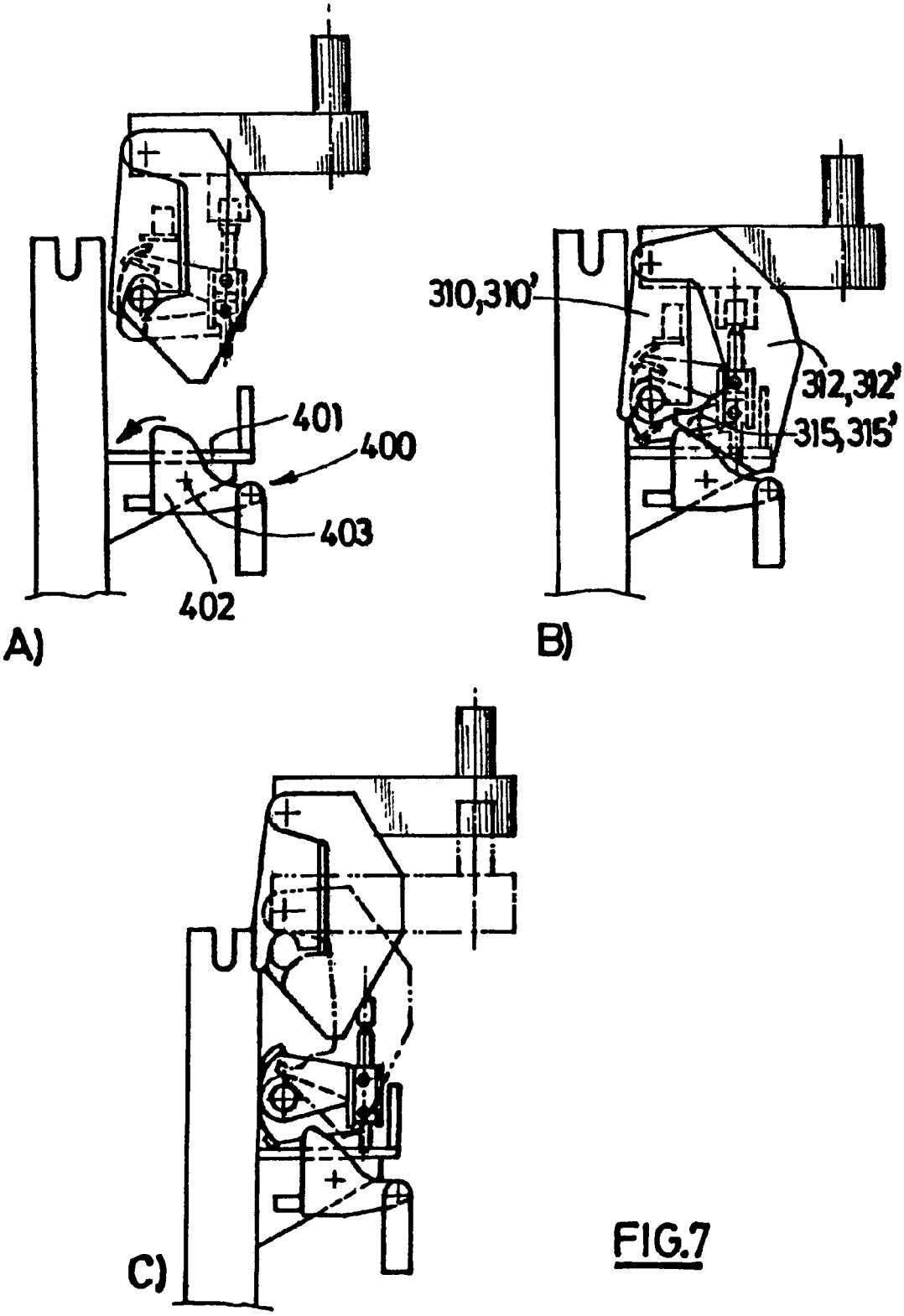
FIG. 7 illustrates a release device for the handling device.

FIG. 7 illustrates a release device (400) capable of releasing the handling device when the connector is not inserted in the normal position inside the handling device. The device (400) comprises a receptacle (401) capable of supporting the connector (200) and a lever (402) capable of pivoting about an axis (403). The lever (402) is initially moved sideways so as to release the sides of the receptacle (see the arrow in FIG. 7(A)). The handling device (300) in which a connector (200) is inserted outside the normal position is moved towards the device (400) so as to put the connector into the receptacle (401) (FIG. 7(A)). Pressure is then exerted on the connector until the mobile members (312, 312') can be pivoted without being hindered until they reach the open position under the action of lever (402) on the cams (315, 315') (FIG. 7(B)). The handling device can then be raised freely leaving the connector in the receptacle (FIG. 7(C)).

List of Numeric Marks

List of numeric marks

| | |
|---|---|
| 1 | Electrolytic cell |
| 2 | Electrolytic pot |
| 3 | Superstructure |
| 4 | Gantry |
| 5 | Anode frame |
| 6 | Connecting rods |
| 7 | Levers |
| 8 | Anode |
| 9 | Anode stem |
| 10, 10' | Attachment hooks |
| 11, 11' | Hook recess |
| 12, 12' | Hook end |
| 20 | Lifting and handling unit |
| 21 | Traveling crane |
| 22 | Carriage |
| 23, 23' | Running tracks |
| 24 | Telescopic arm |
| 100 | Electrolysis room |
| 200 | Connector |
| 201, 202 | Levers |
| 203, 204 | Cross-pieces |
| 205, 206 | Nuts |
| 210 | Tightening screw |

List of numeric marks-continued

| | |
|---|---|
| 211 | Screw head |
| 212, 212' | Side trunnions |
| 213 | Connector axis |
| 231, 232 | Gripping means (such as a projecting rim) |
| 300 | Connector handling device |
| 301 | Handling device frame |
| 302 | Tightening device (or spanner or wrench) |
| 303 | Pivot axis |
| 304 | Handling device attachment means |
| 305, 305' | Opening |
| 310, 310' | Guide means (such as a fork) |
| 311, 311' | Recess |
| 312, 312' | Mobile member |
| 313, 313' | Support |
| 314, 314' | Recess |
| 315, 315' | Cam |
| 320 | Attachment means (such as a pin) |
| 400 | Release device |
| 401 | Receptacle |
| 402 | Lever |
| 403 | Rotation axis |

Additional advantages, features and modifications will readily occur to those skilled in the art. Therefore, the invention in its broader aspects is not limited to the specific details and representative devices, shown and described herein. Accordingly, various modifications may be made without departing from the spirit or scope of the general inventive concept as defined by the appended claims and their equivalents.

All documents referred to herein are specifically incorporated herein by reference in their entireties.

As used herein and in the following claims, articles such as "the", "a" and "an" can connote the singular or plural.

What is claimed is:

1. A handling device capable of handling an anode connector having at least two side trunnions and a screw, said handling device comprising:

a wrench capable of cooperating with the screw so as to affect relative tightness of the connector, a locking system capable of cooperating with the wrench and the connector such that the connector can be locked in a desired position in the handling device by changing the relative tightness of the connector using the wrench, and at least one mobile member having an open position and a closed position, wherein said at least one mobile member comprises a support capable of supporting the connector in the closed position and a means for causing displacement of said at least one mobile member from the closed position to the open position.

2. A handling device according to claim 1, wherein said support is capable of supporting the connector through at least one of said side trunnions, when said at least one mobile member is in said closed position.

3. A handling device according to claim 2, wherein said support is provided with at least one concave recess that is oriented essentially downward during use in said handling device, and wherein at least one trunnion of said two side trunnions can fit into said recess.

4. A handling device according to claim 1, wherein said at least one mobile member comprises a safety lock suitable for reducing displacement of said at least one mobile member from the closed position to the open position when the connector is resting on the support.

5. A handling device according to claim 4, comprising two mobile members each comprising a support, wherein each support comprises:

at least one recess capable of fitting at least one of said side trunnions, wherein each recess has dimensions such that when the connector is locked in said desired position, each said at least one mobile member can move without being hindered, whereas when said side trunnions of the connector rest in said recess, displacement of said at least one mobile member is impeded by said safety locking means.

6. A handling device according to claim 1, wherein said locking system comprises at least one means for attaching that can cooperate with the connector and the wrench so as to lock the connector in the handling device.

7. A handling device according to claim 6, wherein the means for attaching is able to cooperate with the connector through a gripping means provided on the connector.

8. A handling device according to claim 1, wherein said locking system comprises at least one guide that may be fixed or mobile, said at least one guide means being designed to guide insertion of the connector into said locking system.

9. A handling device according to claim 8, wherein said at least one guide comprises a fork.

10. A handling device according to claim 9, wherein said locking system comprises at least two forks arranged so as to allow insertion of the connector between the forks and to provide guidance for each trunnion of the connector by each fork.

11. A handling device according to claim 8, wherein said at least guide is mobile.

12. A handling device according to claim 1, wherein the connector is capable of cooperating with attachment hooks of an aluminum production cell, wherein said means of causing displacement of said at least one mobile member from the closed position to the open position comprises a cam formed on said at least one mobile member that is configured to cooperate with said attachment hooks so as to cause displacement of said mobile member by a relative movement between the handling device and said attachment hooks.

13. A handling device according to claim 1, wherein said at least one mobile member is capable of pivoting about an axis.

14. A connector capable of being handled by the handling device according to claim 1, said connector comprising:

at least two levers, at least two side trunnions, at least one screw, and at least one means for gripping capable of cooperating with the locking system of the handling device so as to lock the connector in said desired position.

15. A connector according to claim 14, wherein the two levers each comprise a cross-piece and said means for gripping comprises a projecting rim provided on at least one of said cross-pieces.

16. A lifting and handling unit comprising at least one handling device according to claim 1.

17. A fused bath electrolysis aluminum production plant comprising a handling device of claim 1.

18. A fused bath electrolysis aluminum production cell comprising a connector according to claim 14.

19. A fused bath electrolysis aluminum production plant comprising a lifting and handling unit of claim 16.

20. A handling device capable of being used for handling an anode connector having at least two side trunnions and a screw, said handling device comprising:

a wrench capable of cooperating with the screw so as to affect relative tightness of the connector, a locking system capable of cooperating with the wrench and the connector such that the connector can be locked in a desired position in the handling device by changing the relative tightness of the connector using the wrench, and at least one mobile member having an open position and a closed position, wherein said at least one mobile member comprises a support capable of supporting the connector in the closed position and is capable of being displaced from the closed position to the open position.

21. A handling device according to claim 20, wherein said support is capable of supporting the connector through at least one of said side trunnions when said at least one mobile member is in the closed position.

22. A handling device according to claim 21, wherein said support is provided with at least one concave recess that is oriented essentially downward during use, and wherein at least one trunnion of the connector can fit into said recess.

23. A handling device according to claim 20, wherein at least one mobile member comprises a safety locking component capable of reducing and/or preventing displacement of said at least one mobile member from the closed position to the open position when the connector is resting on said support.

24. A handling device according to claim 23, comprising two mobile members each comprising a support, wherein each support comprises:

at least one concave recess, each recess being capable of fitting in one of said side trunnions, wherein each recess has dimensions such that when the connector is locked in said desired position, each mobile member can move without being hindered, whereas when said side trunnions of the connector rest in said recesses, displacement of said at least one mobile member is impeded by said safety locking component.

25. A handling device according to claim 20, wherein said locking system comprises at least one fastener capable of cooperating with the connector and the wrench so as to lock the connector in the handling device.

26. A handling device according to claim 25, wherein the fastener is capable of cooperating with the connector through a gripper provided on the connector.

27. A handling device according to claim 20, wherein said locking system comprises at least one guide that may be fixed or mobile, said at least one guide being designed to guide insertion of the connector into the locking system.

28. A handling device according to claim 27, wherein said guide comprises a fork.

29. A handling device according to claim 28, wherein said locking system comprises at least two forks arranged so as to allow insertion of the connector between the forks and to provide guidance for each trunnion of the connector by each fork.

30. A handling device according to claim 27, wherein said guide is mobile.

31. A handling device according to claim 20 wherein the connector is capable of cooperating with attachment hooks of an aluminum production cell, wherein said at least one mobile member comprises at least one cam capable of moving said mobile member to form the open position and configured to cooperate with said attachment hooks so as to cause displacement of said mobile member by a relative movement between the handling device and said attachment hooks.

32. A handling device according to claim 20, wherein said mobile member can pivot about an axis.

33. A connector suitable for handling by the handling device according to claim 20, said connector comprising:

at least two levers, at least two side trunnions, at least one screw, and at least one grip capable of cooperating with the locking system of the handling device so as to lock the connector in a desired position.

34. A connector according to claim 33, wherein the two levers each comprise a cross-piece and said grip comprises a projecting rim provided on at least one of the cross-pieces.

35. A lifting and handling unit comprising at least one handling device for connectors according to claim 20.

36. A fused bath electrolysis aluminum production plant comprising a handling device of claim 20.

37. A fused bath electrolysis aluminum production cell comprising a connector of claim 33.

38. A fused bath electrolysis aluminum production plant comprising a lifting and handling unit of claim 35.

39. A handling device capable of handling an anode connector having at least two side trunnions and a screw, comprising:

a wrench capable of cooperating with the screw so as to affect rightness of the connector and a locking system comprising at least one means for attaching that can cooperate with a means for gripping on the connector and the wrench so as to lock the connector in the handling device.

40. A connector suitable for handling by a handling device, said connector comprising:

at least two levers, at least two side trunnions, at least one screw for controlling said levers, and at least one projecting rim capable of cooperating with a locking system of the handling device so as to lock the connector in a desired position.

41. A handling device capable of being used for handling an anode connector having at least two side trunnions and a screw, said handling device comprising: a locking system designed to maintain the connector in a normal handling position and a mobile member designed to act as a support if a locking failure occurs in the handling device.

* * * * *